US005190909A

United States Patent [19]

Shanton et al.

[11] Patent Number: 5,190,909

[45] Date of Patent: Mar. 2, 1993

[54] RECORD MATERIAL UTILIZING A VINYL CARBINOL OR DERIVATIVE THEREOF AS A CHROMOGENIC COMPOUND

[75] Inventors: Kenneth J. Shanton, Neenah, Wis.; Farid Azizian, Oxon, England

[73] Assignee: The Wiggins Teape Group Limited, Basingstoke, England

[21] Appl. No.: 613,018

[22] Filed: Nov. 15, 1990

[30] Foreign Application Priority Data

Nov. 15, 1989 [GB] United Kingdom ..... 8925850

[51] Int. Cl.[5] ..... B41M 5/136; B41M 5/30

[52] U.S. Cl. ..... 503/218; 427/150; 427/151; 503/223; 503/224

[58] Field of Search ..... 427/150, 151; 503/218, 503/223, 224

[56] References Cited

U.S. PATENT DOCUMENTS 3,930,108 12/1975 Alsop ..... 427/151

FOREIGN PATENT DOCUMENTS

| | | | |
|---|---|---|---|
| 0154528 | 9/1985 | European Pat. Off. | 428/411.1 |
| 0315901 | 5/1989 | European Pat. Off. | 503/218 |
| 2362956 | 7/1974 | Fed. Rep. of Germany | 503/218 |
| 2212788 | 7/1974 | France | 503/218 |
| 2294055 | 7/1976 | France | 503/218 |
| 1432505 | 4/1976 | United Kingdom | 503/227 |
| 1456208 | 11/1976 | United Kingdom | 503/218 |
| 1465669 | 2/1977 | United Kingdom | 503/218 |

OTHER PUBLICATIONS

Sisti et al., "A Convenient General Method for the Preparation of Aldehydes.II", *Journal of Organic Chemistry*, Jan., 1962.

Akiyama et al., "Diphenylmethane and Triphenylmethane Dye . . . Near-Infrared", 9 *Dyes and Pigments* 459-66 (1988).

Gautier et al., "Condensation du Dimsylsodium Avec les . . . ", *Tetrahedron Letters No.* 12, 895-98 (1970).

Gilman et al., "Addition Reactions of Organometallic Compounds With Conjugated Systems", 63 *Journal of the American Chemical Society* 2046-48 (Aug. 1941).

Lutz et al., "The Effect of Configuration on the Reactivity of the Chalcone System", 77 *Journal of the American Chemical Society* 1814-18 (Apr., 1955).

Miocque et al., "Synthese et etude pharmacologique de derives du naphtyl-2 methylsulfoxyde", *Chimie Therapeutique*, 1972, Jul.-Aug., No. 4.

*Primary Examiner*—B. Hamilton Hess

*Attorney, Agent, or Firm*—Burns, Doane, Swecker & Mathis

[57] ABSTRACT

Pressure- or heat-sensitive record material utilizes a chromogenic material of the formula (I) (Ia or Ib):

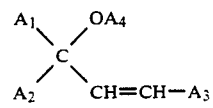

(Ia)

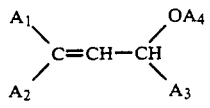

(Ib)

(I)

in which:

one of $A_1$ and $A_3$ is an optionally-substituted carbocyclic aryl group and the other of $A_1$ and $A_3$ is either an optionally-substituted aryl group which is the same as or different from $A_1$, or an optionally-substituted nitrogen-containing aromatic heterocyclic group, with the proviso that if both $A_1$ and $A_3$ are aryl groups, then at least one of $A_1$ and $A_3$ has a substituted amino or -N-heterocyclic substituent in the 4-position (relative to the bond joining $A_1$ or $A_3$ respectively to the remainder of the molecule);

$A_2$ is hydrogen or an optionally-substituted aryl, alkyl or aralkyl group; and $A_4$ is hydrogen or an optionally-substituted alkyl, aryl or aralkyl group.

20 Claims, No Drawings

RECORD MATERIAL UTILIZING A VINYL CARBINOL OR DERIVATIVE THEREOF AS A CHROMOGENIC COMPOUND

This invention relates to record material utilising a vinyl carbinol or a derivative thereof as a chromogenic compound. The record material may be pressure-sensitive or heat-sensitive, and in either case, image formation occurs by a reaction between the chromogenic material and a suitable colour developer to produce a coloured species.

As is well known in the art, pressure sensitive record material typically functions by separating the colour reactive components by a pressure rupturable barrier. Most commonly this barrier is provided by microencapsulating a solution in a suitable organic solvent of one of the reactive components. On application of imaging pressure the microcapsules are ruptured, liberating the solution of one of the reactive components into reactive contact with the other component thereby forming a coloured mark or image corresponding to the applied imaging pressure. It is also known to use other forms of pressure rupturable barrier such as a dispersion of a solution in a waxy continuous layer or a honeycomb structure instead of microcapsules.

Such pressure sensitive record material can be of two basic types: the so-called "transfer" and "self-contained" types. In the transfer type the reactive components are present in coatings on facing surfaces of upper and lower sheets, the coating on the lower surface of the upper sheet comprising the isolated and usually microencapsulated solution of one reactive component and the coating on the upper surface of the lower sheet comprising the other component. Most commonly it is the chromogenic material which is present in the microcapsules in the coating on the lower surface of the upper sheet and the colour developer which is present in the coating on the upper surface of the lower sheet. This is the so-called "normal transfer" pressure sensitive system. An alternative to this is the so-called "reverse transfer" system in which the colour developer is dissolved and microencapsulated and the chromogenic material is present, usually adsorbed on a suitable particulate carrier, in the coating on the upper surface of the lower sheet.

The sheets carrying microencapsulated material on their lower surfaces are usually referred to as "CB" (coated back) sheets and the sheets carrying a reactive coating on their upper surfaces are usually referred to as "CF" (coated front) sheets. In addition it is common to use intermediate sheets which carry appropriate coatings on both upper and lower surfaces and these are usually referred to as "CFB" (coated front and back) sheets.

In self-contained pressure sensitive sheet record material, both reactive components are present on or in a single sheet. Premature reaction is inhibited by microencapsulating one of the components, usually the electron donating chromogenic material. The reactive components can be present in one or more coatings on a surface of the sheet (coated self-contained) or dispersed within the body of the sheet (loaded self-contained).

In heat sensitive sheet record material, the reactive components, i.e. the chromogenic material and the colour developer are initially present in a mutually unreactive state and are then enabled to react together by changes brought about by heat. Most commonly this is achieved by including the chromogenic material and colour developer in the heat sensitive record material as solids. On heating the record material, the chromogenic material and/or the colour developer and/or another component of the system melts and thus permits reactive contact between the chromogenic material and colour developer. As an alternative to the arrangement just described, the chromogenic material and the colour developer may be microencapsulated in solution in a similar manner as for pressure sensitive record material. Imaging then occurs on heat-induced rupture or increased wall permeability of the capsules.

Numerous chromogenic compounds have been used or proposed for use in record material as described above. Examples of commercially successful chromogenic compounds include phthalides such as 3,3-bis(4-dimethylaminophenyl)-6-dimethylaminophthalide (usually referred to as crystal violet lactone or CVL); indolyl phthalides such as 3,3-bis(1-N-ethyl-2-methylindol-3-yl)phthalide, fluorans, particularly amino-substituted fluorans such as 3-(N-methyl-N-cyclohexylamino)-6-chloro-7-methylfluoran and 3-diethlamino-6-methyl-7-N-phenylaminofluoran; and spirodipyrans such as 3'-i-propyl-7-dibenzyl-amino-2,2'-spirodi[2-1-benzopyran].

A number of suggestions have been made to use the carbinol bases of dyestuffs or derivatives of such carbinols, as chromogenic compounds in pressure sensitive record material. Such carbinols do form colour, but do so too readily to be useful in practical systems. Typically, the carbinols will colour up during micro-encapsulation or they are so reactive that small quantities of extracapsular chromogenic material—inevitable because encapsulation is not perfectly efficient and some capsules will be inadvertently broken during handling—produce intense colouration on reaction with the base paper usually used as the substrate. These are serious drawbacks.

The present invention is based on our finding that certain substituted propene carbinols or carbinol derivatives as defined below are good colour formers which do not suffer from the excessive reactivity typical of previously proposed carbinol chromogenic compounds. Certain of these propene carbinol and carbinol derivatives are known per se, although their utility as chromogenic compounds for use in record materials has not previously been disclosed. Thus, 1,1-diphenyl-3-(4-dimethylaminophenyl)prop-2-en-1-ol is referred to in an article by Gilman and Kirby in JACS 63 (1941) 2046 at page 2048. 1-(4-dimethylaminophenyl)-3,3-diphenyl prop-2-en-1-ol is referred to in an article by Sisti, Burgmaster and Fudim in Journal of Organic Chemistry, Vol. 27 (1962), pages 279–281. Neither of these articles disclose any utility for the compounds described. British Patents Nos. 1465669 and 1456208 disclose the use of a broad range of vinyl compounds, including certain vinyl carbinols or carbinol derivatives in pressure- and heat- sensitive record materials respectively, but none of the compounds explicitly exemplified fall within the class of carbinols or carbinols utilised in the present invention, as defined below. Finally, a broad class of tri-substituted prop-2-en-1-ols is described for transfer printing of textiles in British Patent Specification No.1432505.

The present invention provides in a first aspect record material comprising at least one chromogenic material and at least one colour developer therefore, characterized in that the chromogenic material includes at least one compound of the formula (I) (Ia or Ib):

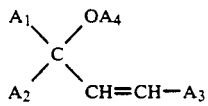

(Ia)

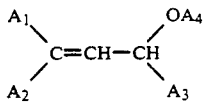

(Ib)

(I)

in which:

one of $A_1$ and $A_3$ is an optionally-substituted carbocyclic aryl group, and the other of $A_1$ and $A_3$ is either an optionally-substituted aryl group which is the same as or different from $A_1$, or an optionally-substituted nitrogen-containing aromatic heterocyclic group, with the proviso that if both $A_1$ and $A_3$ are aryl groups, then at least one of $A_1$ and $A_3$ has a substituted amino or -N-heterocyclic substituent in the 4- position (relative to the bond joining $A_1$ or $A_3$ respectively to the remainder of the molecule);

$A_2$ is hydrogen or an optionally-substituted aryl, alkyl or aralkyl group $A_4$ is hydrogen or an optionally-substituted alkyl, aryl or aralkyl group.

The expression "alkyl" as used in this specification includes not just straight or branched-chain alkyl groups but also cycloalkyl groups.

$A_1$ is preferably a substituted or unsubstituted phenyl or naphthyl group. The nature of the substituent group(s), when present, is not thought to be critical (subject of course to the proviso set out above). Alkyl, ether, halo, substituted amino and optionally-substituted, preferably saturated -N-heterocyclic groups are examples of suitable substituent groups. Substitution is preferably in the 4-position (as defined above), but in the case of an alkyl group, it can equally well be in the 2- position When there are two substituent groups, substitution is preferably in the 2- and 4- positions. When a substituted amino substituent is present, both hydrogens of the amino group are preferably substituted (i e. di-substitution), and the substituents on the amino group are selected from alkyl, aryl and aralkyl groups.

When $A_3$ is an aryl group, it is preferably a substituted or unsubstituted phenyl or naphthyl group. As with $A_1$, the nature of the substituent group(s), when present, is not thought to be critical (subject again to the proviso set out above). Alkyl, ether, halo, substituted amino, and -N-heterocyclic or other nitrogen-containing heterocyclic groups are examples of suitable substituent groups. Substitution is preferably in the 4- position (as defined above). When there are two substituent groups, substitution is preferably in the 2- and 4- positions. When a substituted amino substituent is present, both hydrogens of the amino group are preferably substituted (i e. di-substitution), and the substituents on the amino group are selected from alkyl, aryl and aralkyl groups. p The expression "ether" as used in this specification includes cyclic ethers.

When $A_1$ or $A_3$ is an optionally-substituted nitrogen-containing heterocyclic group, it is preferably an -N-heterocyclic group or an optionally-substituted 3-carbazolyl, 4-pyridinyl or 3-indolyl group. The optional substitution can be on the nitrogen atom, for example with an alkyl group, or elsewhere, for example in the 2-position with a phenyl group.

The -N-heterocyclic substituent groups referred to in the definitions of $A_1$ and $A_3$ above are typically morpholino, piperidino, pyrrolidino or piperazino groups (the last-mentioned may be alkyl-substituted on the second nitrogen atom). Saturated -N-heterocyclic groups are preferred.

The halo substitution referred to in the definition of $A_1$ and $A_3$ above is normally with chlorine.

$A_2$ is preferably hydrogen, a tertiary butyl, cyclopentylmethyl or other bulky alkyl group or a phenyl group which is unsubstituted or is substituted with an alkyl or an ether group. By a bulky alkyl group is meant a group which is sufficiently bulky to displace $A_1$ from the spatial position it would otherwise occupy in the molecule.

$A_4$ is preferably hydrogen, an alkyl group, or a phenyl group which is unsubstituted or is substituted with a nitro group.

The chromogenic compounds disclosed herein for use in record material give rise to a wide range of different colours on contact with typical carbonless paper colour developers. This is a particular benefit of the invention. The colour obtained in the case of any particular chromogenic compound is dependent on the chemical nature of the chromogenic compound. This is discussed further below in relation to a number of preferred sub-classes of chromogenic compound.

When one of $A_1$ and $A_3$ is a phenyl or naphthyl group substituted in the 4- position with an ether group, and the other of $A_1$ and $A_3$ is a phenyl or naphthyl group substituted in the 4- position with a substituted amino group or with an -N-heterocyclic group, the developed colour is generally blue or cyan, although there can be exceptions to this rule.

When each of $A_1$ and $A_3$ is a phenyl or a naphthyl group substituted in the 4- position with a substituted amino group or with an -N-heterocyclic group, and $A_1$ and $A_3$ are the same or different, the developed colour is generally blue, cyan or green, although again there can be exceptions to this rule.

When one of $A_1$ and $A_3$ is a phenyl or naphthyl group which is unsubstituted or is substituted with an alkyl or halo group, $A_2$ is an optionally-substituted aryl group or an aralkyl group, and the other of $A_1$ and $A_3$ is a phenyl or naphthyl group substituted in the 4- position with a dialkylamino group or with an -N-heterocyclic group, the developed colour is generally red-magenta, magenta, blue-magenta, reddish blue, purple or blue. The hue obtained is influenced by the substituents on whichever of $A_1$ and $A_3$ is not substituted in the 4- position with a substituted amino or -N-heterocyclic group.

When $A_1$ is a phenyl or naphthyl group which is unsubstituted or is substituted with an alkyl or halo group, $A_2$ is a tertiary butyl, cyclopentylmethyl or other bulky alkyl group and $A_3$ is a phenyl or naphthyl group substituted in the 4- position with a dialkylamino group or with an -N-heterocyclic group, the developed colour is generally yellow or orange.

When one of $A_1$ and $A_3$ is a 3-carbazolyl, 4-pyridinyl or 3-indolyl group and the other of $A_1$ and $A_3$ is a phenyl group substituted in the 4- position with a dialkylamino or -N-heterocyclic group, the developed colour varies with the nature of the heterocyclic group. For example, when $A_3$ is pyridyl, the developed colour is typically yellow or orange, whereas when $A_3$ is carbazolyl, the developed colour is typically blue or green, and when $A_3$ is indolyl, the developed colour is typically yellow or green.

Compounds of the general formulae (I) can be made from known starting materials by synthetic routes involving generally known techniques. We have successfully used the following route to make compounds of the formula (Ia) and to convert these to the corresponding compounds of the formula (Ib). In the sequence outlined below the symbols $A_1$, $A_2$, $A_3$ and $A_4$ are as defined for formula (I) above.

Step i

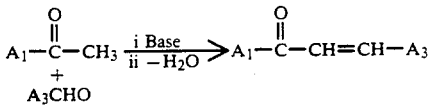

This reaction is a base catalysed condensation followed by elimination of water. We expect that the elimination of water occurs by a concerted mechanism such that the intermediate unsaturated ketone is trans-substituted. This is consistent with our observation from TLC, IR and NMR data that the intermediate is obtained as a single compound, rather than a mixture of isomers that would otherwise be expected.

Step ii (Applicable where $A_2$ is other than hydrogen)

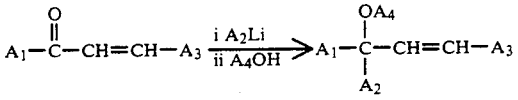

We believe from TLC and NMR data that this reaction proceeds without altering the stereochemistry around the double bond. The second reaction stage is particularly convenient when it is desired to generate the (Ia) carbinols, since $A_4OH$ is then water. when $A_2$ is hydrogen, a compound of formula (Ia) is conveniently obtained by direct reduction of the product from Step i above, for example by means of sodium borohydride in methanol.

Step iii (Applicable where it is desired to produce a compound of formula (Ib))

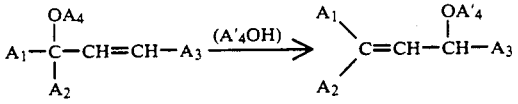

where $A'_4$ is a group of the formula $A_4$.

The reaction will usually be carried out in one of two ways:

(a) Two Stage

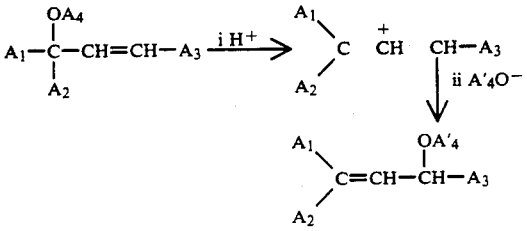

(b) Single Stage

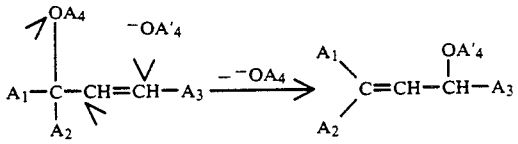

Generally the two stage reaction is easier to control. The two stage reaction would be expected to generate a mixture of cis- and trans-products and our NMR observations support this.

A variation on the synthesis of compounds of the formula (Ia) is possible by "interchanging" $A_1$ and $A_2$ in the synthesis, thus:

step i

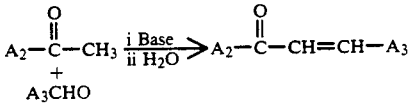

step ii

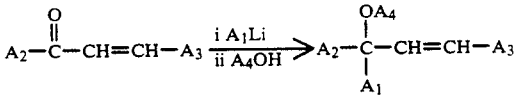

The synthesis of compounds of the formula Ib can follow as described above. This variation is particularly useful where the $A_2Li$ compound is difficult to handle, for example where $A_2$ is an alkyl or aralkyl group.

As is referred to above, the compounds of the general formula (I) can exist in cis- and trans- forms (about the ethylenic double bond). We believe that this isomerism is not of fundamental importance in colour formation. The particular isomer or the precise proportions in a mixture of cis- and trans- isomers will depend on the detail of the manufacturing route used. The compounds of the general formula (I) have two structural isomeric forms, the "a" and "b" forms of general formulae (Ia) and (Ib) above. These are related as 1- and 3-allylic carbinols or carbinol ethers. The colours produced from corresponding "a" and "b" forms are, at least, very similar (leaving group and stereochemical effects may make them non-identical in practical use).

The compounds of the general formula (I) will react with typical carbonless paper colour developers to generate often very intense colours. The most intense colours available approach the intensity of CVL, which is recognized as giving a very intense colour, and have absorption peaks which are very broad, i.e. the peaks cover a large absorption area. Thus they are potentially very efficient chromogenic compounds. For example, the compound 1-phenyl-1-(4-piperidinophenyl)-3-(4-methoxyphenyl)prop-2-en-1-ol (Synthesis Example 4 below) gives a coloured form on an acid-washed dioctahedral montmorillonite clay CF with $\lambda$ max=595 nm and a ½height peak width of ca. 190 nm (490–680 nm). The absorption intensity is similar to that of CVL on the same CF on which CVL gives $\lambda$ max=616 nm and a ½height peak width of ca. 125 nm (525 to 650 nm).

Generally, we have found that the chromogenic compounds of the general formula (I) form more intense colours more quickly and to give more intense colours with typical inorganic or mineral carbonless colour developers than with organic, particularly phenolic resin, colour developers. In particular, effective inorganic or mineral colour developers include acid washed montmorillonite colour developers such as those sold under the trade names "Silton" by Mizusawa Chemical Co., "Copisil" by Sud-Chemie AG, and "Fulacolor" by Laporte Industries Ltd., or semi-synthetic mineral colour developers made by modifying acid washed montmorillonites.

The chromogenic compounds of the formula (I) can be present in record material in combination with conventional chromogenic compounds, for example those referred to earlier in this specification.

The pressure-sensitive record material of the invention typically utilises paper as a substrate. The pressure rupturable barrier can be provided by any means known in the art but will usually be provided by dissolving the chromogenic compound(s) in a suitable, usually oily, solvent and microencapsulating the solution by any of the encapsulation techniques known for carbonless paper. Examples include coacervation microencapsulation, typically using gelatin as a major component of the capsule wall, interfacial polymerization encapsulation techniques and synthetic polymer based encapsulation methods not involving interfacial polymerization notably those of aminoplast encapsulation systems, in particular those based on ureaformaldehyde or melamine-formaldehyde materials.

Whilst the compounds of the formula (I) are in general less effective with organic colour developers than with inorganic colour developers, they are in principle at least usable with organic colour developers in both pressure-sensitive and heat-sensitive record material.

The following Examples illustrate the invention. All parts and percentages are by weight unless otherwise stated. Synthesis Examples (SE) 1 to 68 relate to the synthesis of compounds of the general formula (I). Application Examples (AE) 1 to 4 relate to investigation of properties specifically related to pressure sensitive record material and to specific illustrations of the use of compounds of the general formula (I) in such record material. Application Example 5 relates to heat-sensitive record material.

Synthesis Examples 1 to 6, 67 and 68 are described in detail hereafter. Synthesis Examples 7 to 66 follow one of these detailed Examples, but, in each case, substituting the appropriate starting materials to obtain the desired product. Specifically, SE 12 follows the general method of SE 3; other compounds of the formula (Ia) were made by the method of SE 1 or SE 2; carbinol compounds of the formula (Ib)-were made by the method of SE 6; and ether compounds of the formula (Ib) were made by the method of SE 5. In the reaction stage ii of SE 1, SE 2, SE 3 and SE 4 as applied to other compounds the quantity of the lithium compound was adjusted to get a desired balance of reaction speed, yield (completeness of reaction) and minimising byproducts.

The nature of the substituents in the Synthesis Examples is detailed in Table 1 below, in which the following abbreviations are used for substituent groups:

| | | |
|---|---|---|
| Me = methyl | Et = ethyl | Bu = n-butyl |
| $Bu^t$ = t-butyl | Pe = pentyl | Hp = heptyl |
| Oc = octyl | Do = dodecyl | Np = naphthyl |
| cHx = cyclohexyl | cPM = cyclopentyl-methyl | Ind = indol-3-yl |
| Bz = benzyl | Ph = phenyl | |
| Mor = N-morpholino | Pip = N-piperidino | |
| Pyr = N-pyrrolidino | Pz = N-piperazino | |
| MPz = N-(4-N-methyl)piperazino | Py = pyridin-4-yl | |
| Cz = carbazol-3-yl | | |

Substitution on groups abbreviated in this way is indicated numerically so 4-$Me_2N$.Ph = 4-dimethylaminophenyl, 2,4-$Me_2$.Ph = 2,4-dimethylphenyl and so on.

TABLE 1

Structures of Compounds of Synthesis Examples

| SE No | Formula | $A_1$ | $A_2$ | A3 | $A_4$ |
|---|---|---|---|---|---|
| 1 | Ia | Ph | Ph | 4-$Me_2N$.Ph | H |
| 2 | Ia | 4-Mor.Ph | Ph | 4-$Me_2N$.1-Np | H |
| 3 | Ia | Ph | $Bu^t$ | 4-$Me_2N$.Ph | H |
| 4 | Ia | 4-Pip.Ph | Ph | 4-MeO.Ph | H |
| 5 | Ib | 4-Pip.Ph | Ph | 4-MeO.Ph | Me |
| 6 | Ib | 4-Pip.Ph | Ph | 4-MeO.Ph | H |
| 7 | Ia | 4-Pip.Ph | Ph | 4-$Me_2N$.Ph | H |
| 8 | Ia | 4-MPz.Ph | Ph | 4-$Me_2N$.Ph | H |
| 9 | Ia | 1-Np | Ph | 4-$Me_2N$.Ph | H |
| 10 | Ia | 4-Mor.Ph | Ph | 4-MeO.Ph | H |
| 11 | Ia | Ph | Ph | 2-Cl-4-$Me_2N$.Ph | H |
| 12 | Ia | Ph | cPM | 4-$Me_2N$.Ph | H |
| 13 | Ia | 4-Pip.Ph | Ph | 4-BzO-Ph | H |
| 14 | Ia | 4-MeO.Ph | Ph | 4-$Me_2N$.Ph | H |
| 15 | Ia | 2-Np | Ph | 4-$Me_2N$.Ph | H |
| 16 | Ia | 4-$Me_2N$.Ph | Ph | 4-Pyr.Ph | H |
| 17 | Ia | Ph | Ph | 2-Me-4-$Me_2N$.Ph | H |
| 18 | Ia | 4-Me.Ph | Ph | 4-$Me_2N$.Ph | H |
| 19 | Ia | 4-Mor.Ph | Ph | 4-$Me_2N$.Ph | H |
| 20 | Ia | 4-Me.Ph | Ph | 2-Cl-4-$Me_2N$.Ph | H |
| 21 | Ia | 4-Ph.Ph | Ph | 4-$Me_2N$.Ph | H |
| 22 | Ia | 4-Pip.Ph | Ph | 4-PhO.Ph | H |
| 23 | Ia | 4-Cl.Ph | Ph | 4-$Me_2N$.Ph | H |
| 24 | Ib | 4-Mor.Ph | Ph | 4-MeO.Ph | Me |
| 25 | Ia | 4-$Me_2N$.Ph | Ph | 4-$Me_2N$.Ph | H |
| 26 | Ib | 4-Me.Ph | Ph | 4-$Me_2N$.Ph | Me |
| 27 | Ia | 4-$Bu^t$.Ph | Ph | 4-$Me_2N$.Ph | H |
| 28 | Ia | 4-MPz.Ph | Ph | 4-MeO.Ph | H |
| 29 | Ia | 4-Pip.Ph | Ph | Ph | H |
| 30 | Ia | 4-Pip.Ph | Ph | 4-EtO.Ph | H |
| 31 | Ib | 4-Me.Ph | Ph | 4-$Me_2N$.Ph | 4-$NO_2$.Ph |
| 32 | Ia | 4-Pip.Ph | Ph | 1-Np | H |

TABLE 1-continued

| Structures of Compounds of Synthesis Examples | | | | | |
|---|---|---|---|---|---|
| SE No | Formula | $A_1$ | $A_2$ | A3 | $A_4$ |
| 33 | Ia | 4-cHx.Ph | Ph | 4-$Me_2$N.Ph | H |
| 34 | Ia | 4-Pip.Ph | Ph | 9-Et.Cz | H |
| 35 | Ia | 4-Pip.Ph | Ph | 4-Me.Ph | H |
| 36 | Ib | 4-Mor.Ph | Ph | 4-MeO.Ph | Et |
| 37 | Ia | 4-$Me_2$N.Ph | Ph | 4-MeO.Ph | H |
| 38 | Ia | 4-Pip.Ph | 4-Me.Ph | 4-MeO.Ph | H |
| 39 | Ia | 4-Ph.Ph | Ph | 4-Pyr.Ph | H |
| 40 | Ia | 4-Mor.Ph | Ph | 1-Np | H |
| 41 | Ia | 4-Mor.Ph | Ph | Ph | H |
| 42 | Ib | 4-Me.Ph | Ph | 4-$Me_2$N.Ph | H |
| 43 | Ia | 4-Pip.Ph | Ph | 9-Bu.Cz | H |
| 44 | Ia | 4-Pip.Ph | 4-MeO.Ph | 4-MeO.Ph | H |
| 45 | Ia | 4-$Me_2$N.Ph | Ph | 3-MeO-4-DoO.Ph | H |
| 46 | Ia | 4-Pip.Ph | Ph | 4-Py | H |
| 47 | Ia | 4-$Me_2$N.Ph | Ph | 4-HpO.Ph | H |
| 48 | Ia | 4-Mor.Ph | Ph | 4-MeO.1-Np | H |
| 49 | Ia | 4-$Me_2$N.Ph | Ph | 9-Bu.Cz | H |
| 50 | Ia | 4-$Me_2$N.Ph | Ph | 4-PeO.Ph | H |
| 51 | Ia | 4-Mor.Ph | Ph | 9-Bu.Cz | H |
| 52 | Ib | 4-Pip.Ph | Ph | 4-MeO.Ph | Ph |
| 53 | Ia | 2-Me.Ph | Ph | 4-$Me_2$N.Ph | H |
| 54 | Ia | 2,4-$Me_2$.Ph | Ph | 4-$Me_2$N.Ph | H |
| 55 | Ia | 4-MeO.Ph | Ph | 4-(MePhN).Ph | H |
| 56 | Ia | 4-MeO.Ph | Ph | 4-(Me (4-MeOPh)N).Ph | H |
| 57 | Ia | 4-$Me_2$N.Ph | Ph | N-Me-2-Ph.Ind | H |
| 58 | Ia | 4-MeO.Ph | Ph | 4-($Bz_2$N).Ph | H |
| 59 | Ia | 4-MeO.Ph | Ph | 2-Cl-4-$Et_2$N.Ph | H |
| 60 | Ia | 4-MeO.Ph | Ph | 4-$Et_2$N.Ph | H |
| 61 | Ia | 4-MeO.Ph | Ph | 4-Pip.Ph | H |
| 62 | Ia | 4-MeO.Ph | Ph | 4-Pyr.Ph | H |
| 63 | Ib | 4-MeO.Ph | Ph | 4-(MePhN).Ph | H |
| 64 | Ib | 4-MeO.Ph | Ph | 4-$Me_2$N.Ph | H |
| 65 | Ib | 4-MeO.Ph | Ph | 4-(MePhN).Ph | Me |
| 66 | Ib | 4-MeO.Ph | Ph | 4-$Me_2$N.Ph | Me |
| 67 | Ia | 4-MeO.Ph | H | 4-(MePhN).Ph | H |
| 68 | Ia | 4-MeO.Ph | H | 4-$Me_2$N.Ph | H |

In the Synthesis Examples and in Table 2 below, melting points are open capillary uncorrected values. Compounds for which no melting point is given were obtained as oily products or amorphous solids and were not purified. Generally, these products were fairly pure (many gave easily readable IR and NMR spectra) but may have contained impurities or residual solvent. Yield figures are % of the theoretical maximum on the limiting intermediate precursor i.e. values are for the final step of the synthesis. NMR spectra were run on a Hitachi Perkin-Elmer R600 NMR spectrometer at 60 MHz generally in deuterochloroform using tetramethyl silane (TMS) as internal standard. Sometimes, perdeuterobenzene ($C_6D_6$) and for one sample dimethylsulphoxide (DMSO) were used as the solvent using TMS as internal standard. Infra red (IR) spectra were run on a Perkin-Elmer 728 Infra red spectrophotometer. The IR samples were prepared as thin films generally from chloroform ($CHCl_3$ or $CDCl_3$) solution and evaporating the solvent. The IR spectra obtained showed no appreciable signs of residual solvent, in particular the characteristic peaks of $CHCl_3$ at ca. 2400 $cm^{-1}$ and $CDCl_3$ at ca. 2220 $cm^{-1}$ were absent or not significantly above the baseline. Occasionally carbon tetrachloride was used as the solvent or the IR was run on a thin film of a hydrocarbon oil (Nujol) mull of the solid compound.

The intermediate vinyl ketones referred to in the Synthesis Examples below, were also analysed by NMR and IR spectroscopy. The results afforded further, if indirect, evidence for the structures of the chromogenic compounds of the general formula (I).

SYNTHESIS EXAMPLE 1

1,1-Diphenyl-3-(4-dimethylaminophenyl)prop-2-en-1-ol i.

1-Phenyl-3-(4-dimethylaminophenyl)-1-oxo-prop-2-ene

Acetophenone (28.0 g, 0.15 mole) and 4-dimethylaminobenzaldehyde (22.35 g, 0.15 mole) were dissolved in methanol (150 ml) in a 500 ml, 3-necked round bottom flask. The flask was wrapped in aluminium foil to exclude light and was fitted with a mechanical stirrer and a water cooled condenser. The third neck was stoppered and used to obtain samples for monitoring during the reaction. Aqueous sodium hydroxide solution (50 ml of 30% w/v) was added dropwise to the vigorously stirred clear methanolic solution. A yellow-/orange solid started separating from the reaction solution (which had turned orange) after about 24 hours. Stirring was continued for about 48 hours at ambient temperature and the intermediate title compound was isolated by vacuum filtration, washed successively with water, methanol and petroleum ether (40–60° C.) and dried in vacuo to give 23.3 g (62% of theory) of 1-phenyl-3-(4-dimethylaminophenyl)-1-oxo-prop-2-ene with a melting point of 112–114° C.

ii.

1,1-Diphenyl-3-(4-dimethylaminophenyl)prop-2-en-1-ol

1-Phenyl-3-(4-dimethylaminophenyl)-1-oxo-prop-2-ene (11.79 g, 0.047 mole) prepared in stage i above was dispersed in sodium dried diethyl ether (200 ml) in a 11 3-necked round bottom flask fitted with a magnetic stirrer and a water cooled condenser itself fitted with a guard tube containing silica gel to prevent the ingress of moisture. The side necks were closed with rubber septa and the system purged with dry nitrogen via a needle through one of the septa. Phenyl lithium (29.5 ml of a 2M solution in cyclohexanediethyl ether, 0.059 mole i.e. a 25% molar excess) was added using a syringe through the other septum while the contents of the flask were vigorously stirred using the magnetic stirrer and a slow steady stream of dry nitrogen maintained through the apparatus. The addition of the phenyl lithium caused the colour of the reaction mix to change from orange to green. After completion of the addition of phenyl lithium the reaction mixture was kept stirred at ambient temperature for 4 hours and the progress of the reaction was monitored by tlc on silica plates eluted with 1:1 (v/v) ethyl acetate petroleum : ether (40–60° C.) on samples of the reaction mix.

When the reaction was complete, water (300 ml) was added carefully to the reaction mix to quench residual phenyl lithium and liberate the product carbinol. This resulted in a two-phase mixture. The organic phase contained most of the colour former, but a certain amount was assumed to be present in the aqueous phase. The two phases were separated, and the aqueous layer was extracted with diethyl ether (3×200 ml). The resulting ether extracts were combined with the organic phase referred to above, and the whole was dried over anhydrous sodium sulphate. The ether was removed using a rotary evaporator leaving the crude solid title compound. The crude product was recrystallized from petroleum ether (40–60° C.) : toluene (9:1 v/v) to give 1,1-diphenyl-3-(4-dimethylaminophenyl)prop-2-en-1-ol as a buff coloured solid in a yield of 6.96 g (45% of theory) with a melting point of 117–118.4°.

SYNTHESIS EXAMPLE 2

1-phenyl-1-(4-N-morcholinophenyl)-3-(4-dimethylamino naphth-1-yl)prop-2-en-1-ol i.

1-(4-N-morpholinophenyl)-3-(4-dimethylaminonaphth 1-yl)-l-oxo-prop-2-ene

The intermediate title compound, having a melting point of 153–155° C., was made by the general method set out in Synthesis Example 1 but using 4-N-morpholinoacetophenone and 4-dimethylamino-1-naphthaldehyde as the starting materials.

ii

1-Phenyl-1-(4-N-morpholinophenyl)-3-(4-dimethylamino naphth-1-yl)prop-2-en-1-ol Sodium dried ether (50 ml) was placed in a 3-necked 11 round bottom flask fitted with a mechanical stirrer, water cooled condenser and calcium chloride drying tube, and a dropping funnel containing bromobenzene (6.1 g, 0.039 mole). Lithium metal (0.54 g, 0.078 mole) cut into small pieces was put into the flask and a few crystals of iodine were added. A portion of the bromobenzene (ca. 0.5 g) was added to the reagents in the flask and the mixture was warmed gently without stirring until reaction began. The mixture was then stirred and the remaining bromobenzene added dropwise. The reaction mixture was stirred for 30 minutes after the addition of bromobenzene was complete, by which time all of the lithium had reacted. A solution of 1-(4-N-morpholinophenyl)-3-(4-dimethylaminonaphth-1-yl)-1-oxo-prop-2-ene (5 g, 0.013 mole), made in stage i above, in sodium dried benzene (200 ml) was added to the phenyl lithium solution in the flask in portions (4×50 ml). The orange-yellow solution was stirred at ambient temperature for 1 hour, by which time the colour had changed to pale yellow. TLC on the reaction mixture using 1:1 (v/v) ethyl acetate : petroleum ether (40–60° C.) as eluent showed that the reaction was complete.

The title compound was recovered by adding water (100 ml) dropwise to the reaction mixture to quench excess phenyl lithium and release the carbinol and the mix was stirred for a further 30 minutes at ambient temperature. The organic layer was then separated, washed with water (3×50 ml), dried over magnesium sulphate and the solvent removed on a rotary evaporator to give a sticky yellow solid. This crude product was recrystallized from a mixture of toluene and petroleum ether (40–60° C.) (1:9 v/v) to give 1-phenyl-1-(4-N-morpholinophenyl)-3-(4-dimethylaminonaphth-1-yl)prop-2-en-1-ol as a pale cream crystalline solid in a yield of 3.3 g (55% of theory) with a melting point of 112–115° C.

SYNTHESIS EXAMPLE 3

1-t-Butyl-1-phenyl-3-(4-dimethylaminophenyl)prop-2-en-1-ol i.

1-N-Butyl-3-(4-dimethylaminophenyl)-1-oxo-prop-2-ene t-Butylmethylketone (pinacolone) (10 g, 0.1 mole) and 4-dimethylaminobenzaldehyde (14.9 g, 0.1 mole) were dissolved in methanol (100 ml) and reacted with aqueous sodium hydroxide solution (50 ml of 30% w/v) under the conditions described in SE 1. During the reaction the clear methanolic solution turned yellow. Stirring was continued for 48 hrs at ambient temperature, by which time a yellow solid had separated from the reaction mixture. The intermediate title compound was isolated as described in SE 1 to give 4.72 g (20% of theory) of 1-N-butyl-3-(4-dimethylaminophenyl)-1-oxo-prop-2-ene, having a melting point of 71.5° C.

ii.

1-N-Butyl-1-phenyl-3-(4-dimethylaminophenyl)-prop-2-en-1-ol 1-t-Butyl-3-(4-dimethylaminophenyl)-1-oxo-prop-2-ene (4 g, 0.017 mole) prepared in stage i above was reacted with phenyl lithium (made from lithium; 0.73 g, 0.105 mole, and bromobenzene; 8.2 g, 0.052 mole) under the conditions described in SE 2 above. The title compound was isolated and recrystallized as described in SE 2 to give 1-N-butyl-1-phenyl-3-(4-dimethylaminophenyl)prop-2-en -1-ol as a cream solid at a yield of 41% of theory, having a melting point of 105–106° C.

SYNTHESIS EXAMPLE 4

1-Phenyl-1-(4-N-piperidinophenyl)-3-(4-methoxyphenyl)-prop-2-en-1-ol

The title compound was made by the general method described in SE 1 but substituting 4-N-piperidinoacetophenone and 4-methoxybenzaldehyde for the acetophenone and 4-dimethylaminobenzaldehyde used in SE 1. The solid product was obtained at 52% (of theory) yield, having a melting point of 114–116° C.

SYNTHESIS EXAMPLE 5

1-Phenyl-1-(4-N-piperidinophenyl)-3-(4-methoxyphenyl)-prop-1-en-3-methoxide

1-Phenyl-1-(4-N-piperidinophenyl)-3-(4-methoxyphenyl)prop2-en-1-ol (2.0 g, $5\times10^{-3}$ mole) made as described in SE 4 was dispersed in analytical purity (dry) methanol (150 ml) under stirring at ambient temperature. Dry HCl gas was bubbled through the dispersion until all the starting material had dissolved to give a blue solution. Solid sodium methoxide was then added to the solution in small portions (very roughly 50 mg per portion) by means of a spatula until the solution became colourless. Water (250 ml) was then added with stirring to quench any excess methoxide and the reaction mixture was extracted with chloroform (250 ml). The chloroform extract was dried over magnesium sulphate and the solvent was removed on a rotary evaporator to give ca. 2 g (ca. 96% of theory) of 1-phenyl-1-(4-N- piperidinophenyl)-3-(4-methoxyphenyl)prop-1-en-3-methoxide as a yellow oil.

The NMR spectrum indicated that the product is almost certainly a mixture of cis- and trans-isomers (probably about 50:50).

SYNTHESIS EXAMPLE 6

1-Phenyl-1-(4-N-piperidinophenyl)-3-(4-methoxyphenyl)-prop-1-en-3-ol

1-Phenyl-1-(4-N-piperidinophenyl)-3-(4-methoxyphenyl)prop2en-1-ol (0.5 g, $1.25\times10^{-3}$ mol) made as described in SE 4 dissolved in a mixture of ether (100 ml) and water (100 ml). Dilute hydrochloric acid (2M, an excess) was added to the mixture dropwise and stirring was continued for 30 minutes after the acid addition was completed. Aqueous sodium hydroxide solution (10M) was then added dropwise to the stirred mixture until the mix became colourless and stirring was continued for a further hour to ensure complete reaction (probably not necessary as colour loss is expected to indicate complete reaction). The ethereal layer was then separated, washed with water ($2\times100$ ml), dried over magnesium sulphate and the ether removed on a rotary evaporator to give 1-phenyl-1-(4-N-piperidinophenyl)-3-(4-methoxyphenyl)prop-1-en-3-ol as an oil.

SYNTHESIS EXAMPLES 7 to 66

Further compounds of the general formula I were made by the methods of SE 1 to SE 6 as specified above. The structures of these compounds (and those of SE 1 to SE 6) are set out in Table 1 above.

SYNTHESIS EXAMPLE 67

This illustrates the synthesis of a chromogenic compound of formula (I) in which Az is hydrogen, namely 1-(4-methoxyphenyl)-3-(4-dimethylaminophenyl)prop-2-en-1-ol, by reduction of a chalcone with sodium borohydride in methanol according to the following reaction sequence:

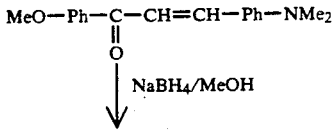

-continued

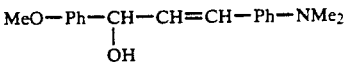

1-(4-methoxyphenyl)-3-(4-dimethylaminophenyl)-1-oxo-prop-2-ene (14.1 g, 0.05 mol) was dispersed in methanol (100 ml). Sodium borohydride (5.6 g, 0.15 mol) was added slowly at ambient temperature under vigorous stirring. After completion of the addition of sodium borohydride the reaction mixture was kept stirred at ambient temperature for 5 hours. When the reaction was complete, the reaction mixture was poured into water (500 ml), and extracted with toluene. The toluene was removed using a rotary evaporator leaving an oily residue. The crude product was crystallized from methanol to give 1-(4-methoxyphenyl)-3-(4-dimethylaminophenyl)prop-2-en-1-ol as a white coloured solid in a yield of 4.0 g (28.3% of theory) with a melting point of 137–148° C.

SYNTHESIS EXAMPLE 68

This illustrates the syntheses of a further chromogenic compound of the formula (I) IN WHICH $A_2$ is hydrogen, namely 1-(4-methoxyphenyl)-3-(4-phenylmethylaminophenyl)prop-2-en1-ol, by a method analogous to that of SE 67 and according to the following reaction sequence:

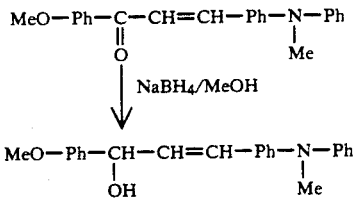

1-(4-methoxyphenyl)-3-(4-phenylmethylaminophenyl)-1-oxoprop-2-ene (13.7 g, 0.04 mol) was dispersed in methanol (100 ml). Sodium borohydride (4.1 g, 0.11 mol) was added slowly at ambient temperature under vigorous stirring. After completion of the addition of sodium borohydride, the reaction mixture was kept stirred at ambient temperature for 20 hours. When the reaction was complete, the reaction mixture was poured into water (500 ml), and extracted with toluene. The toluene was removed using a rotary evaporator leaving an oily residue. The crude product was purified from petroleum ether : toluene (9:1 v/v) to give 1-(4-methoxyphenyl)-3-(4-phenylmethylaminophenyl)prop-2-en-1-ol as an amorphous solid in a yield of 12.3 g (89.1% of theory).

Table 2 below gives yield and melting point data (where determined) on the compounds made in SE 7 to SE 68 (even where no data is quoted, the compounds were actually made, and analysed by IR and/or NMR spectroscopy, except for SE 3 to 68).

TABLE 2

| SE No. | Yield (%) | m.p. (°C.) |
|---|---|---|
| 7 | 7 | 110–113 |
| 8 | 13 | 165–172 |
| 9 | | oil |
| 10 | 90 | 159–162 |
| 11 | 47 | 145–149 |
| 12 | 26 | 62–64 |
| 13 | 13 | 120–122 |
| 14 | 79 | 82–83 |

TABLE 2-continued

| SE No. | Yield (%) | m.p. (°C.) |
|---|---|---|
| 15 | 32 | 118–121 |
| 16 | 15 | 132–135 |
| 17 | 46 | 110–114 |
| 18 | 57 | 105–107 |
| 19 | 21 | oil |
| 20 | 51 | 137–138 |
| 21 | 15 | 151–154 |
| 22 | | oil |
| 23 | 48 | 104–105 |
| 24 | | oil |
| 25 | 8 | 88–90 |
| 26 | | oil |
| 27 | | oil |
| 28 | 60 | 165–166 |
| 29 | 18 | 118–121 |
| 30 | 18 | 119–123 |
| 31 | | oil |
| 32 | | 137–140 |
| 33 | 53 | 101–103 |
| 34 | | oil |
| 35 | 44 | 125–130 |
| 36 | | oil |
| 37 | | oil |
| 38 | | oil |
| 39 | 38 | 102–103 |
| 40 | 48 | 185–188 |
| 41 | 47 | 157–160 |
| 42 | | oil |
| 43 | | oil |
| 44 | | oil |
| 45 | | oil |
| 46 | | oil |
| 47 | | oil |
| 48 | 94 | 141–142 |
| 49 | | oil |
| 50 | | oil |
| 51 | | oil |
| 52 | | oil |
| 53 | 39 | 114–115 |
| 54 | 32 | 116–119 |
| 55 | 64 | 160–163.5 |
| 56 | | oil |
| 57 | 22 | 159–168 |
| 58 | 1.4 | amorphous solid |
| 59 | 65 | 99–103 |
| 60 | 79 | 97–103 |
| 61 | | amorphous solid |
| 62 | 29.8 | 98–114 |
| 63 | | amorphous solid |
| 64 | | amorphous solid |
| 65 | | amorphous solid |
| 66 | | amorphous solid |
| 67 | 28.3 | amorphous solid |
| 68 | 89.1 | 137–148 |

APPLICATION EXAMPLE 1

Each f the compounds made in the Synthesis Examples was tested by making up a solution (1% w/v) in a 2:1 (v/v) mixture of partially hydrogenated terphenyl (Santasol 340 from Monsanto) and kerosene (Exxsol form Exxon Chemicals) and coating the solution by means of a laboratory gravure hand coater onto inorganic clay CF paper, utilising montmorillonite colour developer as the active component. The coloured image produced was allowed to develop in the dark for 48 hours and was then assessed visually for colour (hue) and for most compounds the UV-visible spectrum (in the range of ca. 350–750 nm) was taken on a Philips PU 8800 UV-visible spectrophotometer. The λ max values of the main absorption peak/band was measured instrumentally together with the peak locations of subsidiary peaks at significantly different wavelengths. From the plotted spectrum the bandwidth range at ½ maximum peak height (½ ht range) was measured (to the nearest 5 nm). For some compounds, the image intensity (Int.) of such samples was assessed visually i.e. in effect by visual comparison with known colour formers with the results being quoted on a ranking scale of 5 (most intense) to 1 (least intense), and the fade performance assessed by exposing similarly prepared samples to light in a fade cabinet (effectively a tray strongly illuminated in a standard fashion with light from fluorescent tubes) for periods of 0, 1, 3, 5 and 24 hours. Fade is assessed visually (effectively by comparison with known controls) with the results being quoted on a ranking scale of 5 (least fade) to 1 (most fade). The results of these tests are set out in Table 3 below. For compounds of the invention recovered as oily products, the image intensity and ½ peak height bandwidth figures may underrecord the performance of the compounds because the presence of impurities or residual solvent reduces the amount actually present in solution. For comparison, CVL gives a blue colour on the CF with λ max at 616 nm, a ½ height peak width of ca. 125 nm (525–650 nm) an intensity ranking of 4 and a fade ranking of 2.

TABLE 3

Summary of Testing in Application Example 1

| SE No | Colour | max (nm) | ½ ht. range (nm) | Int. | Fade |
|---|---|---|---|---|---|
| 1 | red-magenta | 528 | 440–620 | 5 | 4 |
| 2 | blue | 744 | 535–805 | 4 | 3 |
| 3 | yellow | 470 | <350–550 | 5 | 5 |
| 4 | blue | 595 | 490–680 | 4 | 5 |
| 5 | blue | 595 | 490–680 | 4 | 5 |
| 6 | blue | 595 | 520–675 | | |
| 7 | green | 741 (465) | 650–780 | 4 | 2 |
| 8 | blue | 628 | 510–740 | 4 | 2 |
| 9 | red-magenta | 543 | 450–610 | 2 | 2 |
| 10 | blue-cyan | 652 (434) | 515–690 | 4 | 4 |
| 11 | blue-magenta | 560 | 455–640 | | |
| 12 | orange-red | 508 | 420–590 | 3 | 3 |
| 13 | blue | 587 | 480–670 | 5 | 3 |
| 14 | blue | 590 | 480–675 | 5 | 5 |
| 15 | blue-magenta | 562 | 460–645 | 3 | 2 |
| 16 | green | 737 (462) | 640–780 | 4 | 3 |
| 17 | red-magenta | 525 | 440–610 | | |
| 18 | blue-magenta | 562 | 480–645 | 5 | 5 |
| 19 | cyan | 725 (458) | 590–765 | 4 | 3 |
| 20 | reddish-blue | 577 | 480–655 | 5 | 3 |
| 21 | magenta | 556 | 460–625 | 5 | 4 |
| 22 | reddish-blue | 579 | 480–660 | 4 | |
| 23 | red-magenta | 526 | 450–605 | 5 | 5 |
| 24 | blue-cyan | 653 (434) | 515–700 | | |
| 25 | green | 737 (460) | 630–780 | 4 | 3 |
| 26 | blue-magenta | 597 | 460–630 | | |
| 27 | magenta | 557 | 470–630 | 3 | 4 |
| 28 | cyan | 644 (451) | 585–675 | 3 | 2 |
| 29 | red-magenta | 527 | 445–615 | 4 | 2 |
| 30 | blue | 595 | 485–685 | 5 | 5 |
| 31 | magenta | 562 | 460–640 | | |
| 32 | reddish-blue | 590 | 500–670 | 2 | 2 |
| 33 | magenta | 560 | 460–635 | 5 | 4 |
| 34 | cyan | 719 (456) | 595–735 | 4 | 3 |
| 35 | blue-magenta | 566 | 465–640 | 5 | 3 |
| 36 | blue | 653 | 540–685 | | |
| 37 | blue | | | | |
| 38 | blue | 595 | 505–675 | 3 | 3 |
| 39 | magenta | 546 | 450–650 | 3 | 4 |
| 40 | blue | 619 | 515–695 | 4 | 2 |
| 41 | magenta | 560 | 470–630 | 4 | |
| 42 | magenta | 560 | 460–640 | | |
| 43 | cyan | 718 | 600–755 | 3 | 3 |
| 44 | blue | 606 | 495–580 | | |

TABLE 3-continued

Summary of Testing in Application Example 1

| SE No | Colour | max (nm) | ½ ht. range (nm) | Int. | Fade |
|---|---|---|---|---|---|
| 45 | blue | 590 | 505–670 | 4 | 3 |
| 46 | orange | 480 (730) | 405–545 | | |
| 47 | blue | 590 | 510–765 | 3 | 2 |
| 48 | cyan | 718 (478) | 605–765 | 5 | 4 |
| 49 | cyan | 688 (354) | ~500–765 | 4 | |
| 50 | blue | 595 (636) | 505–675 | 4 | 3 |
| 51 | cyan | 727 | 650–760 | 3 | 2 |
| 52 | blue | 596 | 515–670 | | |
| 53 | magenta | 521 | 445–610 | | |
| 54 | magenta | 530 | 450–620 | | |
| 55 | blue | 650 (605) | 530–687 | 5 | 5 |
| 56 | blue | 650 (610) | 532–692 | 3 | 4 |
| 57 | yellow-green | 675 | 642–700 | 3 | 3 |
| 58 | blue | 658 (610) | 532–690 | 3 | 3 |
| 59 | blue | 655 (605) | 530–687 | 4 | 5 |
| 60 | purple | 595 | 502–647 | 4 | 5 |
| 61 | purple | 598 | 502–670 | 3 | 4 |
| 62 | purple | 595 | 515–645 | 4 | 5 |
| 63 | blue | 650 (605) | | 5 | 5 |
| 64 | purple | 589 | | 4 | 5 |
| 65 | blue | 650 (605) | | 5 | 5 |
| 66 | purple | 589 | | 4 | 5 |
| 67 | blue | 580 | | | |
| 68 | purple | 560 | | | |

For SE 67 and SE 68, intensity and fade testing was carried out and the results were satisfactory. However, the testing and ranking procedure described earlier was not followed, and so no data is quoted.

APPLICATION EXAMPLE 2

The chromogenic compounds of SE Nos. 1, 3, 4, 10, 11, 17, 18, 19, 23, 53 and 54 were each separately encapsulated i.e. as single colour formers, in solution in 2:1 (v/v) partially hydrogenated terphenyl (Santosol 340) and kerosene (Exxsol) using the aminoplast encapsulation technique described in British Patent No. 1507739.

The chromogenic compounds of SE Nos. 55 to 57 and 59 to 62 were each separately encapsulated by a gelatin coacervation technique as described in British Patent No. 870476 in the same solvent blend as above. The capsule emulsions were each hand coated onto base paper using carbomethoxycellulose as binder and a mixture of wheatstarch and cellulose floc as agents for preventing premature capsule rupture. The CB sheets thus formed were calendered against inorganic clay CF sheets as described in AE1 to give coloured images. In each case the chromogenic compounds were encapsulated successfully and gave capsule emulsions which were substantially colourless (white) or (in the case of SE 19) pale blue. Thus, the chromogenic compounds did not significantly colour up prematurely under the conditions used in the encapsulation process. The coloured images produced on the CF paper matched the colours and/or spectral data given in Table 3 above.

APPLICATION EXAMPLE 3

The chromogenic compound of SE 18 was formulated with other (conventional) chromogenic compounds as follows:

| Chromogenic compound | amount (% w/v) |
|---|---|
| CVL | 0.43 |
| 9-N-butylcarbazol-3-yl-bis(4-N-methyl-N-phenylaminophenyl)methane | 0.4 |
| Compound of SE 18 | 0.5 |
| 3'-iso-propyl-7-dibenzylamino-2,2'-spirobi-[2H-1-benzopyran] | 0.7 |
| 3-N-ethyl-N-(4-methylphenyl)amino-7-N-methyl-N-phenyl-aminofluoran | 0.9 |
| 3-diethylamino-7-chloro-6-methylfluoran | 0.3 |
| 2(3,4-dioctyloxyphenyl)ethen-2-ylquinoline | 0.7 |

This formulation was dissolved in 1:1 (v/v) partially hydrogenated terphenyl (Santosol 340) and kerosene (Exxsol) at a total chromogenic material concentration of 3.93% (w/v) and encapsulated as described in AE 2. The capsule emulsion was hand coated onto base paper as described in AE 2 and imaged, by calendering, typing, impact printing or writing against inorganic clay CF as used in AE 1 to give a good black copy image on the CF.

APPLICATION EXAMPLE 4

The chromogenic compounds of SE Nos. 3 and 4 were combined in a weight ratio of ca. 2:1 to make a chromogenic material formulation that was dissolved (at a total chromogenic material concentration of ca. 5% w/v), encapsulated and coated as described in AE 2. This CB paper was imaged against inorganic clay CF as used in AE 1 to give a stable black copy image. Initially the image was blue, because the chromogenic material of SE 3 developed colour more slowly than that of SE 4, but gradually turned black. This Example illustrates the breadth of the absorption bands of the chromogenic compounds of the invention in that two chromogenic compounds suffice to generate a stable black image on an inorganic clay CF. Typical current commercial products use several chromogenic compounds to achieve black copy images on inorganic clay CF.

APPLICATION EXAMPLE 5

This demonstrates the suitability of the chromogenic compounds of formula (I) for use in heat-sensitive record material.

Three different thermally-sensitive coating formulations were prepared in conventional manner using the chromogenic compounds of SE 4, SE 10 and SE 18, polyvinyl alcohol, a bisphenolic coreactant and other components conventional in heat-sensitive record material. The formulations were separately applied to base paper by means of a laboratory Meyer bar coater, and the thus-coated paper was dried. On application of a thermal stylus, coloured images were formed (blue for the SE 4 formulation, yellow-green for the SE 10 formulation, and pale purple for the SE 18 formulation).

We claim:

1. Record material comprising a support and at least one chromogenic material and at last one colour developer therefore, wherein said chromogenic material includes at least one compound selected from the compounds represented by the formula (I) (Ia or (Ib):

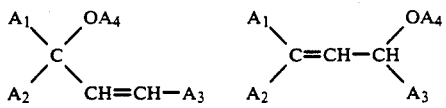

(Ia) (Ib) (I)

wherein one of $A_1$ and $A_3$ is an optionally-substituted carbocyclic aryl group and the other of $A_1$ and $A_3$ is either an optionally-substituted aryl group which is the same or different from $A_1$, or an optionally-substituted nitrogen-containing aromatic heterocyclic group, with the proviso that if both $A_1$ and $A_3$ are aryl groups, then at least one of $A_1$ and $A_3$ has a substituted amino or -N-heterocyclic substituent in the 4-position, relative to the bond joining $A_1$ or $A_1$ respectively to the remainder of the molecule; $A_2$ is hydrogen or an optionally-substituted aryl, alkyl or aralkyl group; and $A_4$ is hydrogen or an optionally-substituted alkyl, aryl or aralkyl group.

2. Record material as claimed in claim 1, wherein $A_1$ is a phenyl group substituted in the 4-position with an alkyl, ether, halo, substituted amino, -N-heterocyclic, or other nitrogen-containing heterocyclic group.

3. Record material as claimed in claim 1, wherein $A_1$ is an unsubstituted phenyl or naphthyl group.

4. Record material as claimed in claim 1, wherein $A_3$ is a phenyl or naphthyl group substituted in the 4-position with an alkyl, ether, halo, substituted amino, -N-heterocyclic or other nitrogen-containing heterocyclic group.

5. Record material as claimed in claim 1, wherein $A_1$ or $A_3$ is a 3-carbazolyl, 4-pyridinyl or 3-indolyl group.

6. Record material as claimed in claim 1, wherein $A_3$ is an unsubstituted phenyl or naphthyl group.

7. Record material as claimed in claim 1, wherein $A_2$ is hydrogen, a bulky alkyl group, or a phenyl group which is unsubstituted or substituted with an alkyl or an ether group.

8. Record material as claimed in claim 7, wherein the bulky alkyl group is a tertiary butyl or cyclopentylmethyl group.

9. Record material as claimed in claim 1, wherein $A_4$ is hydrogen, an alkyl group, or a phenyl group which is unsubstituted or substituted with a nitro group.

10. Record material as claimed in claim 1, wherein one of $A_1$ and $A_3$ is a phenyl or naphthyl group substituted in the 4-position with an ether group, and the other of $A_1$ and $A_3$ is a phenyl or naphthyl group substituted in the 4-position with a substituted amino group or with an -N-heterocyclic group.

11. Record material as claimed in claim 1, wherein $A_1$ and $A_3$ are the same or different and are a phenyl or naphthyl group substituted in the 4-position with a substituted amino group or with an -N-heterocyclic group.

12. Record material as claimed in claim 1, wherein one of $A_1$ and $A_3$ is a phenyl or a naphthyl group which is unsubstituted or substituted with an alkyl, ether, or halo group, and the other of $A_1$ and $A_3$ is a phenyl or naphthyl group substituted in the 4-position with a substituted amino group or with an -N-heterocyclic group, and $A_2$ is an optionally-substituted aryl group.

13. Record material as claimed in claim 1, wherein one of $A_1$ an $A_3$ is a phenyl or naphthyl group which is unsubstituted or substituted with an alkyl, ether, or halo group, and the other of $A_1$ and $A_3$ is a phenyl or naphthyl group substituted in the 4-position with a substituted amino group or with an -N-heterocyclic group, and $A_2$ is a bulky alkyl group.

14. Record material as claimed in claim 13, wherein the bulky alkyl group and a tertiary butyl or cyclopentylmethyl group.

15. Record material as claimed in claim 1 wherein one of $A_1$ and $A_3$ is a 3-carbazolyl, 4-pyridinyl or 3-indolyl group and the other of $A_1$ and $A_3$ is a phenyl group substituted in the 4-position with a substituted amino or -N-heterocyclic group or with an ether group.

16. Record material as claimed in claim 15, wherein the -N-heterocyclic group is a morpholino, piperidino, or pyrrolidino group, or a piperazino group which may be alkyl-substituted on the second nitrogen atom.

17. Record material as claimed in claim 15, wherein the substituted amino group is di-substituted, and the substituents are selected from alkyl, aryl or aralkyl.

18. Record material as claimed in claim 1, wherein the -N-heterocyclic group is a morpholino, piperidino, or pyrrolidino group, or a piperazino group which may be alkyl-substituted on the second nitrogen atom.

19. Record material as claimed in claim 1, wherein the substituted amino group is di-substituted, and the substituents are selected from alkyl, aryl or aralkyl groups.

20. Record material as claimed in claim 1, wherein $A_1$ is a phenyl group substituted in the 2-position with an alkyl group.

* * * * *